US005245171A

United States Patent [19]

Fox et al.

[11] Patent Number: 5,245,171

[45] Date of Patent: Sep. 14, 1993

[54] MAILING ARTICLE WITH AUDIBLE MESSAGE GENERATOR

[76] Inventors: Harvey Fox, 270 N. Atlantic Ave., North Massapequa, N.Y. 11758; Howard Demner, 100 South Middle Neck Rd., Apt. 204, Great Neck, N.Y. 11021

[21] Appl. No.: 558,658

[22] Filed: Jul. 27, 1990

[51] Int. Cl.[5] ..... B65D 27/32

[52] U.S. Cl. ..... 235/492; 40/455; 229/68 R; 493/923; 283/116; 206/232

[58] Field of Search ..... 235/487, 492; 381/188; 206/232; 229/68 R, 74, 92.8; 493/923, 920; 40/455, 124.1; 361/421; 357/74, 85; 283/100, 103, 105, 106, 116

[56] References Cited

U.S. PATENT DOCUMENTS

| | | | |
|---|---|---|---|
| 910,862 | 1/1909 | Ritchie | 283/105 |
| 2,035,218 | 3/1936 | Bloom | 283/106 |
| 3,798,806 | 3/1974 | Sanford | 40/455 |
| 4,102,067 | 7/1978 | Tarrant | 40/455 |
| 4,103,444 | 8/1978 | Jones et al. | 40/124.1 |
| 4,245,775 | 1/1981 | Conn | 229/92.8 |
| 4,299,041 | 11/1981 | Wilson | 40/124.1 |
| 4,607,747 | 8/1986 | Steiner | 40/455 |
| 4,611,262 | 9/1986 | Galloway et al. | 235/487 |
| 4,865,247 | 9/1989 | Grabner | 229/92.8 |
| 4,866,865 | 9/1989 | Yang | 40/455 |

FOREIGN PATENT DOCUMENTS

| | | | |
|---|---|---|---|
| 2439749 | 3/1975 | Fed. Rep. of Germany | 283/103 |
| 2155858A | 10/1985 | United Kingdom | 40/455 |

*Primary Examiner*—John Shepperd
*Assistant Examiner*—Edward Sikorski

[57] ABSTRACT

A mailing piece comprising the usual envelope enclosing a legible text. To induce the recipient to open the envelope and read the text, the envelope has a window (18) at which there is a manually operable actuator for a device which generates an audible message.

13 Claims, 3 Drawing Sheets

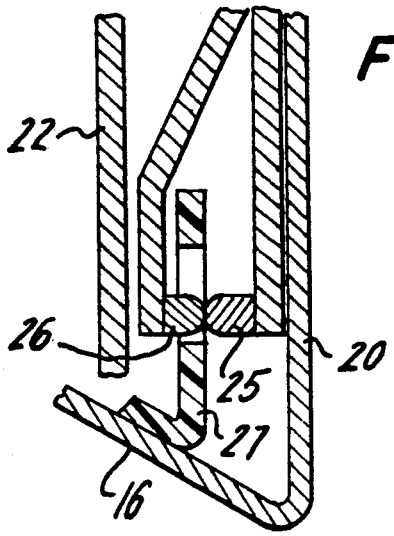
FIG.5
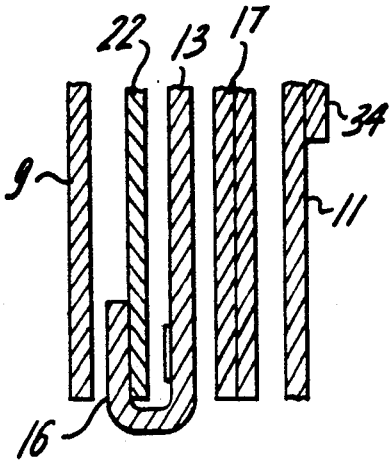
FIG. 4
FIG. 6
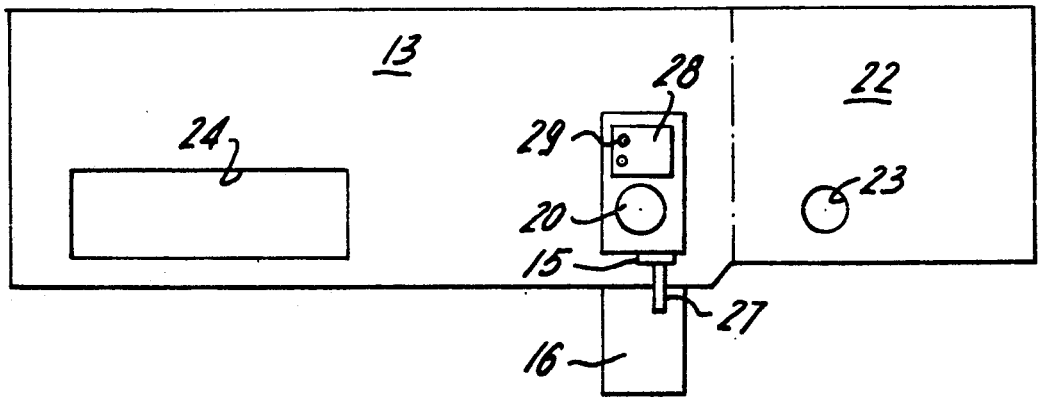
FIG. 7
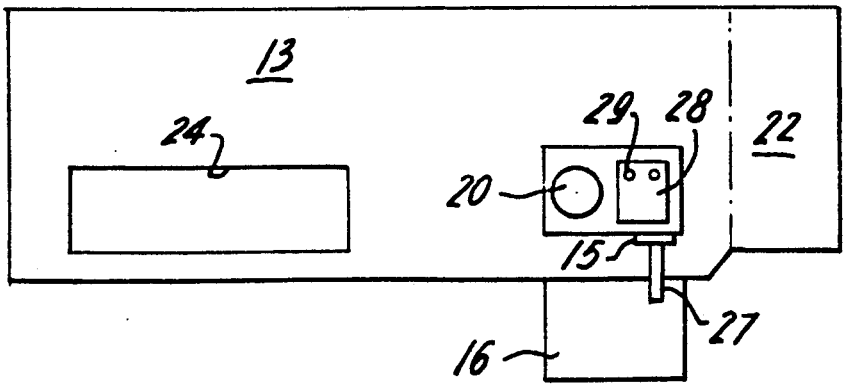

MAILING ARTICLE WITH AUDIBLE MESSAGE GENERATOR

SUMMARY OF THE INVENTION

This invention relates to envelopes or other packages, particularly those used for solicitation, e.g. to prospective customers, contributors, etc. Many such packages are routinely thrown away by the recipients, unopened. The purpose of this invention is to make it more likely that recipients will indeed open the packages to read the text material enclosed therein, by providing a very short piece of introductory audible information, and by providing a reusable audible message generator (e.g. a talking mechanism) which will incline the recipient to retain, reread and show the package to others.

In preferred embodiments of the invention the outer envelope of the package has a tab to be pulled by the recipient to expose an operating element to activate a talking device that gives a short introductory talk.

BRIEF DESCRIPTION OF THE DRAWINGS

Some embodiments of the invention are illustrated in the accompanying drawings in which

FIG. 4 is a schematic partial side view in cross section showing the positions of the various elements within the sealed envelope;

FIG. 5 is a cross-sectional view showing one form of switch to activate the talking device;

FIG. 6 is a plan view showing another arrangement of the talking device on the card;

FIG. 7 is a plan view of a card as in FIG. 2 but having a larger tab so as to expose the speaker of the talking device;

DESCRIPTION OF THE PREFERRED EMBODIMENTS

Figure 2:
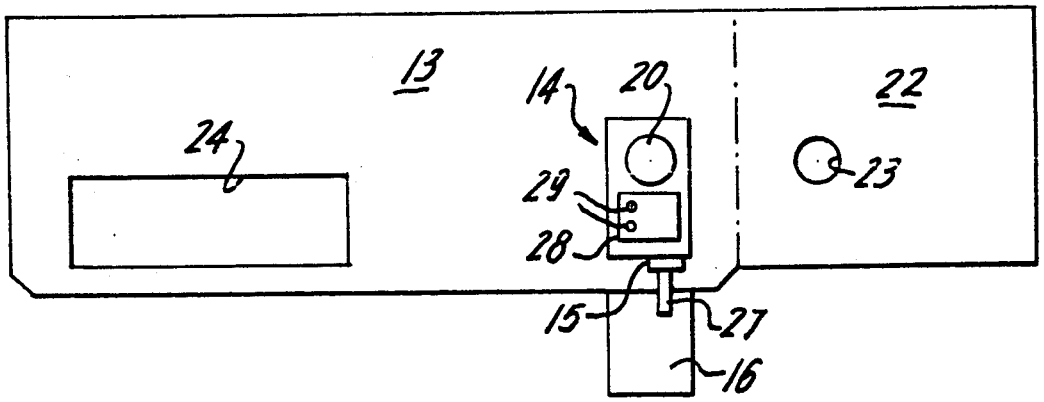
FIG. 2 is a plan view of a card which carries the talking mechanism, with the card being shown in unfolded position.
Figure 3:
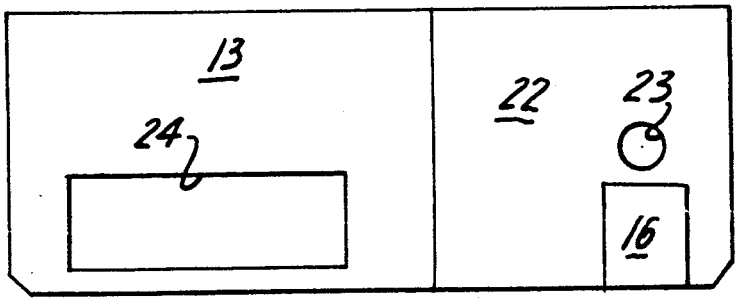
FIG. 3 is a plan view of the card of FIG. 2 shown in the folded position in which it is to be inserted snugly into the envelope of FIG. 1.
Figure 8:
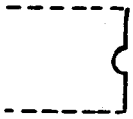
FIGS. 8 to 11 illustrate various forms of envelope tab.
Figure 9:
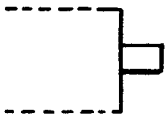
Figure 10:
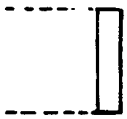
Figure 11:
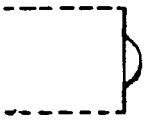

In the drawings reference numeral 8 denotes a mailing envelope, which may be of a standard size (such as a regular #10 envelope measuring about 4 inches by 9½ inches) and which may be provided with a conventional transparent address window 12. In FIG. 4 the front wall of the envelope is designated by reference numeral 9 and its rear wall by reference numeral 11. Within the envelope 8 there is a card 13 (FIGS. 2 and 3) carrying a talking assembly 14, which comprises a talking mechanism and a switch means for activating the latter. The switch means includes a switch 15 and a manually movable switch-operating element, such as a tab 16. Within the envelope there may also be written text material, such as a printed letter or brochure 17. Part, or all, of the text material may be printed on the card 13.

The envelope 8 carries an uncovering means which can be moved by the recipient to expose the switch operating element without opening the envelope. This uncovering means, such as a wind may be a tear-off portion, such as a tab 18 formed by tear lines 19 in a wall (e.g. front wall 9) of the envelope. The front face of the envelope carries printed instructions to lift that tab (e.g. "Lift this tab for a great offer"). When the recipient tears along the tear lines and lifts the tab 18, the switch operating element (e.g. tab 16 on the card 13) is uncovered, together with printed further instructions (e.g. on tab 16) to lift that tab 16. The latter action activates the talking mechanism.

Figure 1:
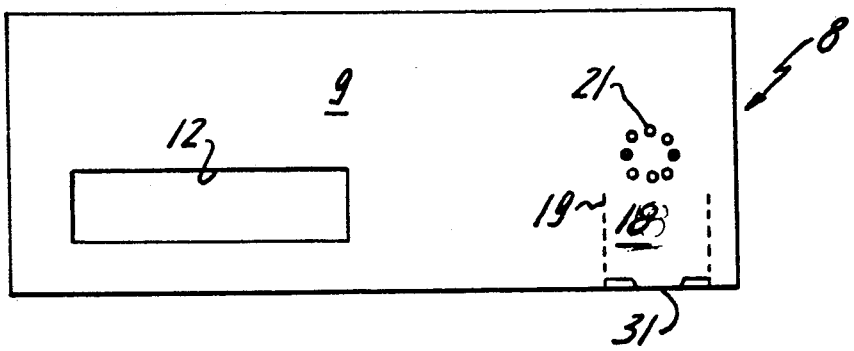
FIG. 1 is a plan view of an envelope used in this invention.

The construction and arrangement are such that the switch operating element is kept in position under the uncovering means (e.g. tab 18) during the transportation of the envelope. For instance the card 13 may, as shown in FIG. 1, be of such size as to fit snugly in the envelope so that it cannot shift position significantly within the envelope (after the latter is sealed).

The talking asembly 14 includes a speaker 20, which may be mounted on the card 13. The envelope may have means 21 for promoting the passage of the sound from the speaker through the envelope. For instance, there may be small openings, such as sets of circular holes or slits, in the portion of the wall of the envelope overlying the speaker. The speaker may face the front or back of the envelope and the means 21 for promoting passage of sound may be correspondingly on the front or the back of the envelope. Comparing FIGS. 2 and 6 the envelope tab 18 may, at least in part, lie over the speaker so that the sound from the speaker need not pass through the material of the envelope.

The card 13 may carry a protective cover for portions of the talking assembly 14. Such a cover may be provided by a foldover portion 22 of the card which may have a cutout portion, such as circular opening 23, to be positioned over the speaker 20.

The address of the intended recipient may, as is conventional, be positioned on the enclosed text material so as to be visible through the window 12. The card 13 may be so shaped that it does not block such visibility. For instance it may have a cut-out, such as opening 24, aligned with the window 12.

The switch means (see FIG. 5) may comprise a stationary electrical contact 25, a movable electrical contact 26 normally biased toward the stationary contact, and a strip 27 of electrically insulating film movable from a position (not shown) in which a portion of the film lies between the contacts and acts to separate them to a position (shown in FIG. 5) in which it permits the contacts to touch each other (e.g. through a slot in strip 27). This strip 27 is operatively connected to the tab 16 for movement therewith. The switch means opens and closes an electrical circuit which comprises a talking microchip 28, of known design, one or more batteries 29 (which may be part of the microchip) and the speaker 20, together with suitable electrical circuit means (not shown) connecting those elements.

The talking microchip may be memory chip such as a known Mosell type chip having voice and/or sound digitized into it, as from audio tape. The card 13 is preferably of material sturdy enough to hold the talking mechanism in place and to take sufficient wear for it to be reusable, both inside the envelope and as a free standing piece once it has been removed from the envelope. Thus it may be of relatively stiff but foldable card stock (e.g. having a thickness in the range of about 0.005 to 0.015 inch, such as about 0.010 to 0.012 inch), heavy paper, laminated plastic, etc. Most preferably it is sturdy enough to be inserted, without damage, snugly into the envelope by conventional envelope stuffing machinery, together with the printed message 17.

Various forms of tab 18 are shown in FIGS. 8 to 11. That tab may be integral with envelope 8, being formed by tear lines 19 (e.g. spaced aligned perforations in the wall of the envelope). Preferably at least a portion of the outer end 31 of tab 18 is free, the envelope material being cut there, so that the recipient can engage that end with a fingernail to start the lifting of the tab. The tab 18 may also be a separate element suitably secured to the envelope (as by pressure-sensitive adhesive so that the tab can be peeled off) to cover an opening in the wall of the envelope overlying the switch-operating element (e.g. tab 16), or the tab 18 may be integral with the envelope but have an extension secured to the tab end to facilitate the lifting of the tab 18. It is also within the broader scope of the invention to omit the tab 18 or other uncovering means, as by providing an opening (i.e. an open window) positioned to expose the switch-operating element (e.g. tab 16) so that the recipient can actuate the latter without having to tear away any portion of the envelope.

Figure 12:
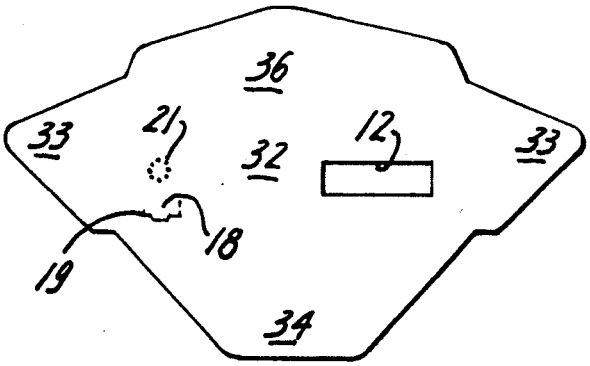
FIGS. 12 and 13 are plan views of envelope blanks.
Figure 13:
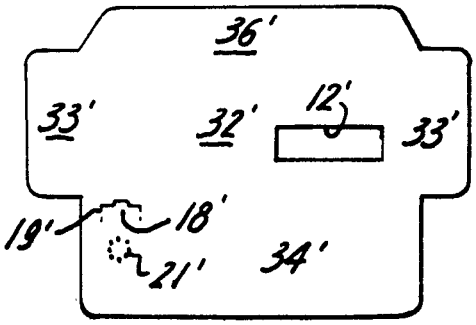

FIGS. 12 and 13 illustrate blanks suitable for forming the envelope 8. The illustrated blanks are of conventional size and shape, comprising a main portion 32, side wings 33 or 33', bottom portion 34 or 34' and sealing flap 36 or 36' all arranged so that the main portion 32 will form the rectangular front wall of the envelope when the blank is folded by machine in the conventional manner (e.g. by folding the side wings inward along lines forming the side edges of the main portion; folding the bottom portion upward, along a line forming the bottom edge of the main portion, onto the infolded side wings and securing that bottom portion to those side wings by adhesive; and then, after the envelope has been filled, folding the sealing flap down to form the top edge of the main portion and adhering that flap to the back wall of the envelope). The illustrated blanks have the usual die-cut address window 12. The blanks also have score lines 19 or 19' to provide the liftable tab 18 or 18' and openings 21 or 21' for transmitting the sound from the speaker 20. When the blank shown in FIG. 13 is formed into an envelope the tab 18' and openings 21' will be on the back of the envelope; the card 13 carrying the talking mechanism will then be inserted so that its tab 16 and speaker 20 correspondingly face the back of the envelope.

Figure 14:
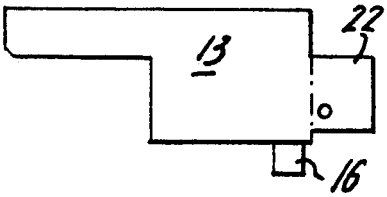
FIG. 14 is a plan view of another form of card.

FIG. 14 illustrates another modified form of the card 13, in which the protective flap 22 is smaller and a whole corner of the card is cut away (instead of having the window opening 23).

In a broader aspect of the invention the protective flap 22 may be omitted. It will be appreciated also that while the flap 22 and tab 16 are preferably integral with the main portion of card 13 they need not be so, but can be separate elements associated with card 13, as by adhesive, tape, etc.

It is also within the broader scope of the invention to secure the talking assembly (without a card 13, or carried on a suitable support) to an inner face of the envelope. This operation may also be carried out by securing (as by adhesive) the talking assembly to the blank used to form the envelope, such as a blank as shown in FIG. 12 or FIG. 13, In that case flap 16 may be omitted and the envelope flap 18 may serve as the switch operating element, as by securing it to the end of strip 27 in the same manner as shown for flap 16.

The operating element for activating the talking mechanism need not be a tab such as tab 16. It may be, for instance, another manually operable device such as a pull string or a switch controller operably by sliding, rotating or pushing it, e.g. a pressure-operated switch accompanied by indicia saying, for instance "squeeze here". It may be a solar cell or other sensor responsive to light that acts to close (or to power) the electrical circuit of the talking mechanism when the envelope tab 18 is pulled up and that sensor is accordingly exposed to light.

In the illustrated embodiments the envelope tab 18 is positioned with its free end near the lower edge of the envelope, so that the recipient will pull the tab upwards. it will be understood that that tab may be placed at other locations (e.g. at either side edge of the envelope or near the top edge, or in the middle of the envelope) and that it may be constructed to be pulled in another direction (e.g. downward or sideways). The foldover portion 22 of the card may be appropriately positioned to protect the talking mechanism and it may fold over, for instance, from the top or bottom of the main portion of the card instead of (as illustrated) from the side.

As previously indicated the envelope may be of the conventional size and shape used for mailing envelopes, such as having a height of about 3½ inches or more (e.g. up to about 12 inches) and a length of about 6½ inches or more (e.g. up to about 16 inches). The tab 18 will generally have an area less than a tenth the area of the envelope, preferably less than about 5% of that area. (For a rectangular envelope, as shown, the area of the envelope is the length of the envelope multiplied by its width; e.g. the area of the previously mentioned #10 envelope measuring 4 inches by 9½ inches is 38 square inches). For instance in one embodiment the envelope tab 18 is about 1 to 2 inches long and about 1 to 2 inches wide, and the tab 16 is smaller than the tab 18, e.g about 1 inch square. The thickness of the talking mechanism is, at present, determined by the thickness of the piezoelectric speaker, e.g. about ⅛ inch or less. The memory chip and switch are much thinner. As batteries, the known button batteries may be employed. The opening 23 in the flap 22 may be situated so that it is concentric with the speaker when that flap is folded inward, and the diameter of that opening may be somehwat less than the diameter of the speaker. The talk message on the chip may be relatively short, e.g. about 10 to 20 seconds, and the chip my be programmed to repeat that message on repeated actuation of the switch.

To facilitate the operation of stuffing the card 13 into the envelope the upwardly folded flap 16 is preferably temporarily secured to the inwardly folded flap 22 by a low strength adhesive, such as a spot of tacky, pressure sensitive wax, which will not significantly affect the ease with which the recipient can lift up the tab 16 to activate the talking mechanism. Also to aid in stuffing the card 13 into the envelope the card may be tapered, e.g. beveled at its lower corners, as illustrated.

It is understood that the foregoing detailed description is given merely by way of illustration and that variations may be made therein without departing from the spirit of the invention.

We claim:

1. A mailing article comprising a mailing envelope enclosing material carrying legible text, said envelope having front and back walls joined to each other at their peripheries to form a closed enclosure, said envelope being a blank having folds that divide said blank into portions which form said front and back walls, wherein the improvement comprises means for inducing the person who receives the envelope in the mail to open it and look at said legible text, said means comprising an acoustic insert in said envelope including a card bearing an audible message generator that has an activating element, a wall of said envelope having a localized access window at said activating element to provide manual access to said activating element while the envelope is still closed against access to said material carrying said legible text, said card and said envelope having means that coact so that the card cannot shift position significantly in said envelope so that said activating element is consequently maintained in position at said access window.

2. A mailing article as in claim 1 in which the contents of said envelope include a letter sheet bearing an address and said front wall has an address window exposing said address to view, said card being free of any address obscuring area, and said means that coact preventing said card from shifting into a position even partly obscuring said address.

3. A mailing article as in claim 1 in which said access window comprises tear lines in one of said walls arranged to form a tab which can be lifted to expose said activating element.

4. A mailing article as in claim 1 in which the envelope is rectangular and sealed and the area of said access window is less than one tenth the area of said envelope, the area of the envelope being its length multiplied by its width.

5. A mailing article as in claim 4 in which said activating element comprises a moveable tab on said card, said envelope being rectangular and the area of said access window and the area of said tab of said card each being less than one tenth of the area of said envelope, the area of said envelope being its length multiplied by its width.

6. A mailing article as in claim 1 wherein said envelope bears an external legible instruction to the recipient to open said access window.

7. A mailing article as in claim 1, wherein an area of one of said walls is apertured for facilitating sound transmission and wherein said audible message generator includes a speaker maintained in position at said apertured area by the coaction of said card and said envelope.

8. A mailing article as in claim 1 in which said audible message generator comprises an audible message generating chip, a speaker and a battery, all electrically connected through electrical contacts controlled by said activating element.

9. A mailing article as in claim 8 in which there is a protective cover lying over said chip, said cover comprising a folded-over extension of said card, said extension being secured, in its folded over position, to the main body of said card by an adhesive, said extension overlying said speaker and having an opening at said speaker to facilitate sound transmission through said extension.

10. A mailing article as in claim 9 in which said front wall has an upper boundary, a lower boundary parallel thereto and side boundaries parallel to each other and perpendicular to said upper and lower boundaries, and in which the contents of said envelope include a letter sheet bearing an address and said envelope has an address window exposing said address to view.

said card being free of any address obscuring area, and said means that coact preventing said card from shifting into a position even partly obscuring said address, said card having a lower boundary and side boundaries and having corners where said card side boundaries meet said card lower boundary, said card being of stiff, foldable card stock having a thickness of at least about 0.005 inch and fitting snugly in said envelope with the lower boundary of said card adjacent the lower boundary of said front wall and the side boundaries of said card adjacent to the respective side boundaries of said wall, said card being bevelled at said corners to aid in stuffing said card into said envelope.

11. A mailing article as in claim 1 in which said envelope contains additional legible text material accessible at said access window.

12. A mailing article comprising a sealed mailing envelope enclosing a letter sheet carrying legible text, said envelope having front and back walls joined to each other at their peripheries to form a closed enclosure, said envelope being a blank having folds that divide said blank into portions which form said front and back walls, said front wall having an upper boundary, a lower boundary parallel thereto and side boundaries parallel to each other and perpendicular to said upper and lower boundaries wherein the improvement comprises means for inducing the person who recognizes the envelope in the mail to open it and look at said legible text, said means comprising an acoustic insert in said envelope including a card bearing an audible message generator that has an activating element, said message generator comprising an audible message generating chip, a speaker and a battery, all electrically controlled by said activating element, a wall of said envelope having a localized access window at said activating element to provide manual access to said activating element while the envelope is still closed against access to said letter sheet carrying said legible text, said envelope having an apertured area in one of said walls overlying said speaker for facilitating sound transmission, said card and said envelope having means that coact so that the card cannot shift position significantly in said envelope so that said activating element is consequently maintained in position at said access window and said speaker is maintained in position at said apertured area, said card being of stiff, foldable card stock having a thickness of at least about 0.005 inch and having a lower boundary and side boundaries, said card fitting snugly in said envelope so as to provide said means that coact so that the card cannot shift position, with the lower boundary of said card adjacent the lower boundary of said front wall and the side boundaries of said card adjacent to the respective side boundaries of said front wall, said envelope having an access tab covering said access window, said access tab being manually liftable to provide access to said activating element, said envelope bearing an external legible instruction to the recipient to lift said access tab.

13. A mailing article comprising a sealed mailing envelope enclosing a letter sheet carrying legible text and an address, said envelope having front and back walls joined to each other at their peripheries to form a closed enclosure, said envelope being a blank having folds that divide said blank into portions which form said front and back walls, said front wall having an upper boundary, a lower boundary parallel thereto and side boundaries parallel to each other and perpendicular to said upper and lower boundaries, said front wall having an address window and said address being exposed to view at said address window, wherein the improvement comprises means for inducing the person who receives the envelope in the mail to open it and look at said legible text, said means comprising an acoustic insert in said envelope including a card bearing an audible message generator that has an activating element, said message generator comprising an audible message generating chip, a speaker and a battery, all electrically controlled by said activating element, a wall of said envelope having a localized access window at said activating element to provide manual access to said activating element while said envelope in still closed against access to said letter sheet carrying said legible text, said envelope having an apertured area in one of said walls overlying said speaker for facilitating sound transmission, said card and said envelope having means that coact so that the card cannot shift position significantly in said envelope so that said activating element is consequently maintained in position at said access window and said speaker is maintained in position at said apertured area, said card being of stiff, foldable card stock having a thickness of at least about 0.005 inch and having a lower boundary and side boundaries, said card fitting snugly in said envelope so as to provide said means that coact so that the card cannot shift position, with the lower boundary of said card adjacent the lower boundary of said front wall and the side boundaries of said card adjacent to the respective side boundaries of said front wall, said envelope having an access tab covering said access window, said access tab being manually liftable to provide access to said activating element, said envelope bearing an external legible instruction to the recipient to lift said access tab.

* * * * *